US008016639B2

(12) United States Patent
Jobe

(10) Patent No.: US 8,016,639 B2
(45) Date of Patent: Sep. 13, 2011

(54) START GATE FOR GRAVITY-DRIVEN CARS

(76) Inventor: John Dewey Jobe, Missouri City, TX (US)

( * ) Notice: Subject to any disclaimer, the term of this patent is extended or adjusted under 35 U.S.C. 154(b) by 350 days.

(21) Appl. No.: 12/321,320

(22) Filed: Jan. 16, 2009

(65) Prior Publication Data

US 2010/0184353 A1 Jul. 22, 2010

(51) Int. Cl.
*A63H 18/00* (2006.01)
*A63H 29/00* (2006.01)

(52) U.S. Cl. ..... 446/429; 446/444

(58) Field of Classification Search ..... 446/168, 446/173, 174, 444–446, 429, 430; 104/53, 104/60, 68
See application file for complete search history.

(56) References Cited

U.S. PATENT DOCUMENTS 3,502,332 A * 3/1970 Wolf ..... 463/69
3,658,333 A * 4/1972 Carcel ..... 463/69
4,132,214 A * 1/1979 Schnurr et al. ..... 124/1
4,342,175 A * 8/1982 Cernansky et al. ..... 446/440
4,715,602 A * 12/1987 May et al. ..... 463/60
6,659,777 B1 * 12/2003 Rondeau ..... 434/416
7,241,223 B1 * 7/2007 Caudill ..... 463/62
7,285,035 B1 * 10/2007 Tullis ..... 446/444

OTHER PUBLICATIONS

Cub Scout Leader "How-To Book" by Boy Scouts of America. Irving, TX 1987. p. 9-40.
The Derby Magic Company owned by Robert Hasse, 2785 Walnut Lake Rd., West Bloomfield, MI 48323.
Micro Wizard, owned by Stuart Ferguson, 10007 Old Union Rd, Union, KY 41091.

* cited by examiner

*Primary Examiner* — Gene Kim
*Assistant Examiner* — Alyssa Hylinski

(57) ABSTRACT

An improved start gate for gravity-driven cars which is itself a gravity-driven compound pendulum. The pendulum includes a horizontal drop member rigidly connected at one end to a start post support rod which in turn supports a plurality of start posts. A trigger lever, when moved either directly or remotely, allows the drop member to fall as in a compound pendulum thereby rotating the start posts and allowing the cars to start. The embodiment teaches that the subsequent initial start post acceleration is approximately twice the car acceleration. The equations of motion are solved showing that the start posts are guaranteed not to interfere with car motion. A major advantage over prior art spring-loaded start gates is that the gate "slap" from stopping overly-forceful spring motion and the associated track jarring and car jostling is eliminated, thereby contributing substantially to a more smooth and fair start.

4 Claims, 7 Drawing Sheets

FIG. 1
Prior Art
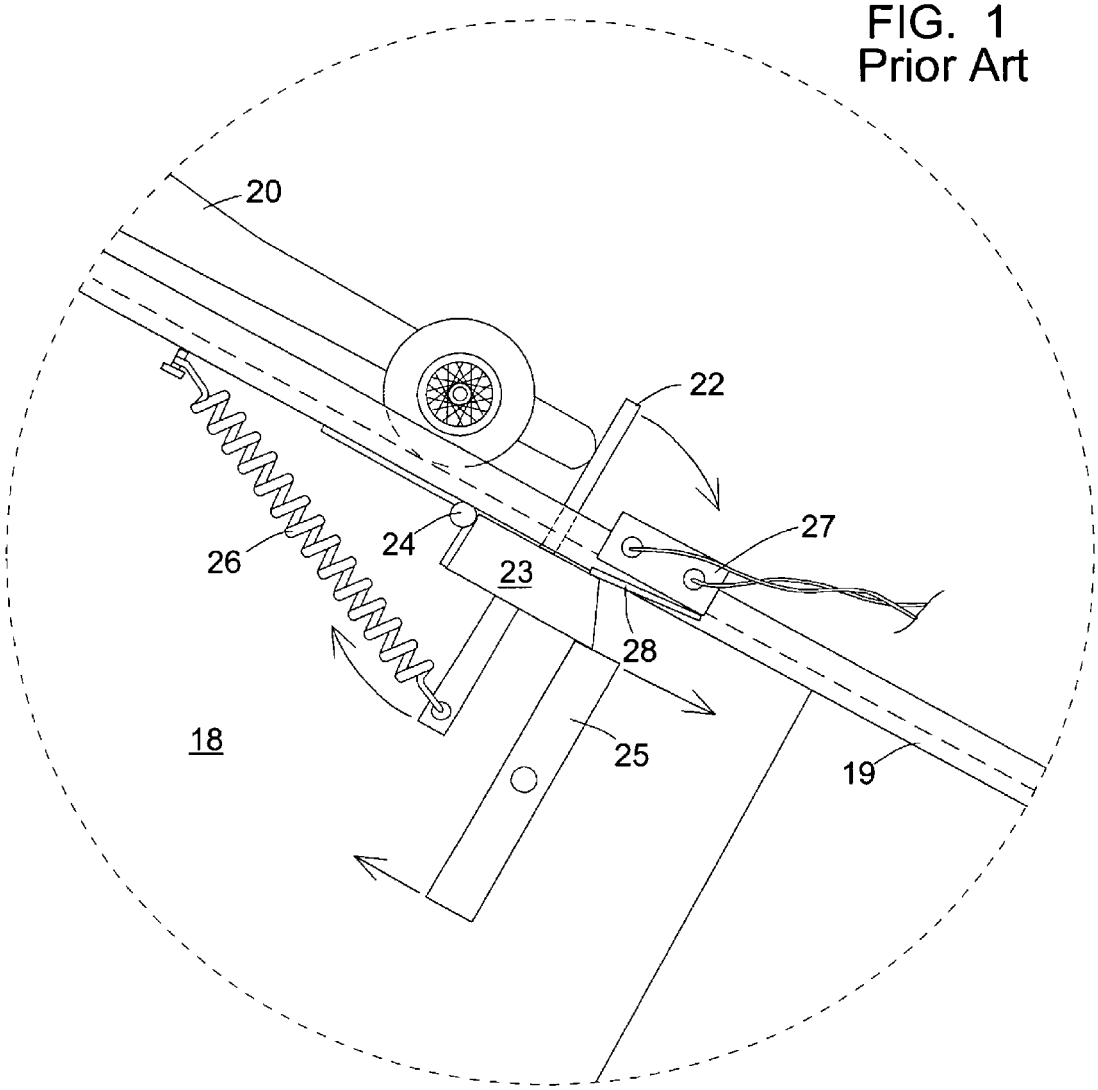
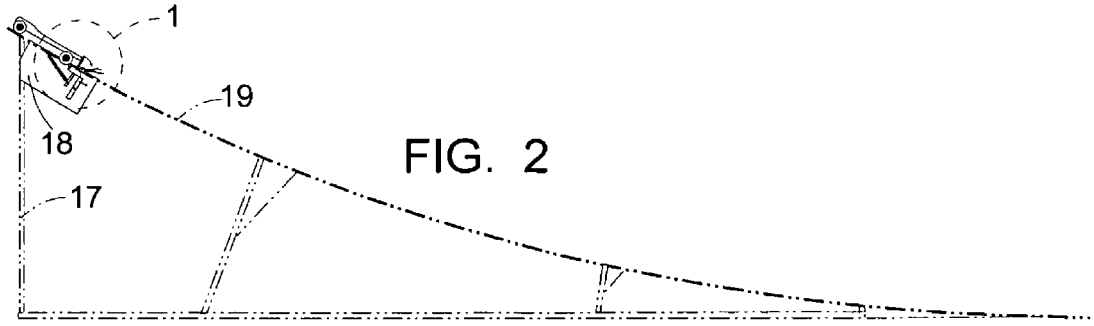
FIG. 2

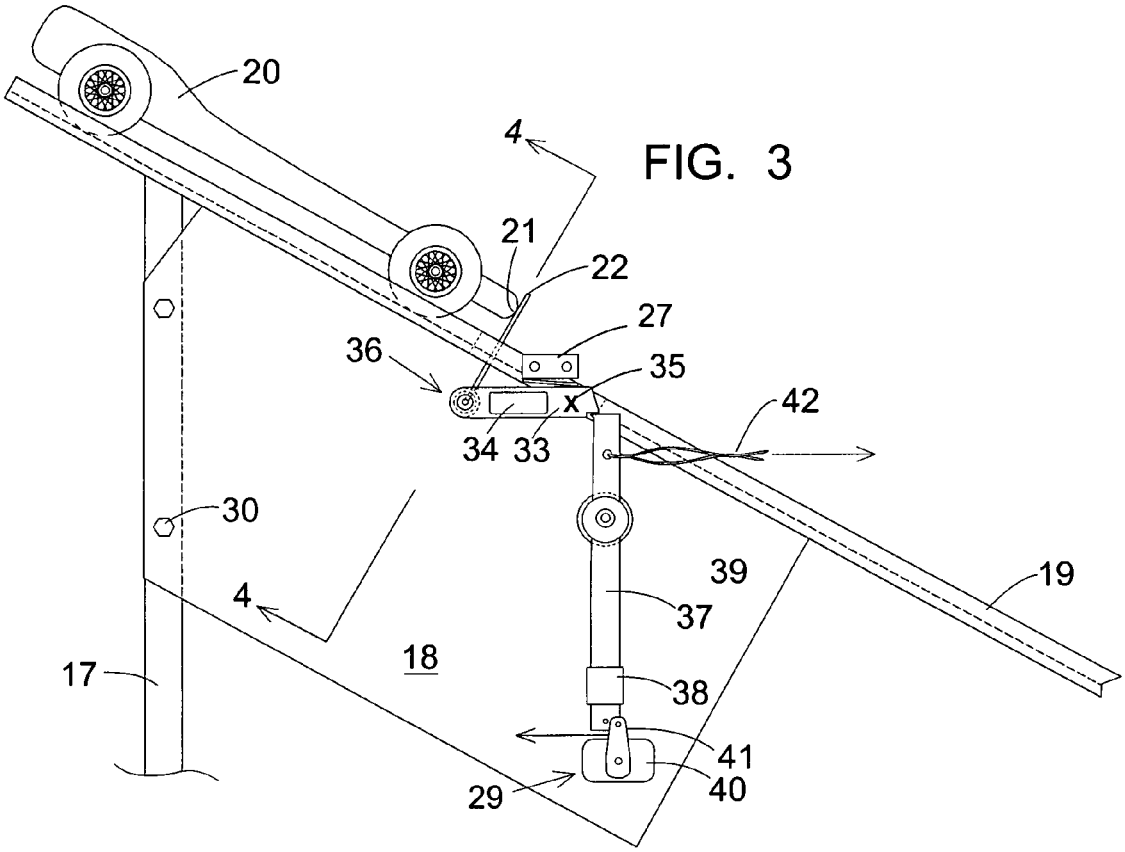
FIG. 3
FIG. 4
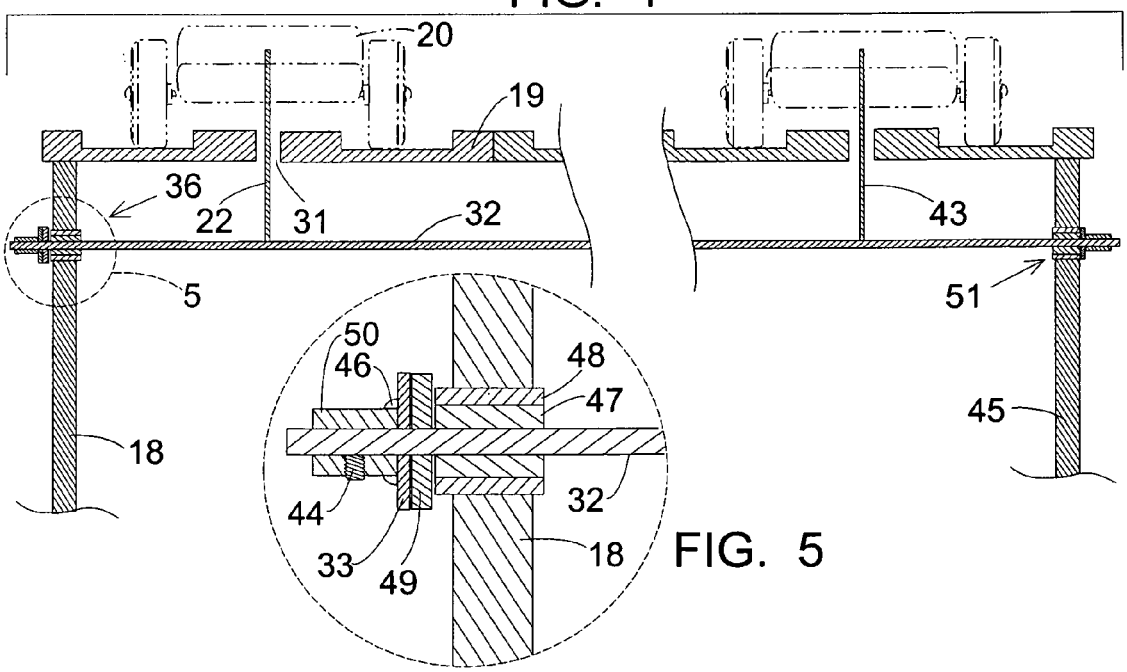
FIG. 5

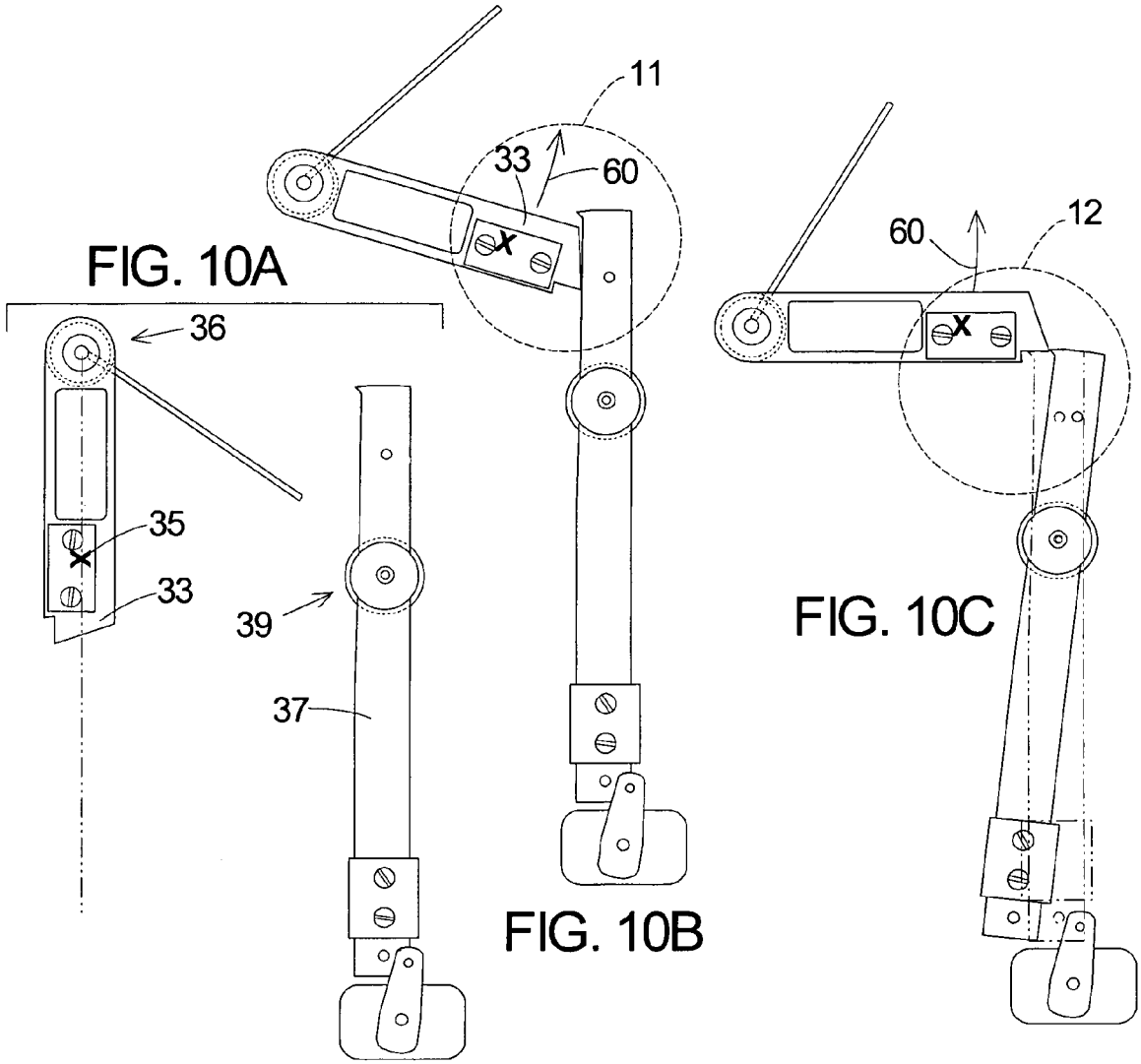
FIG. 10A
FIG. 10B
FIG. 10C
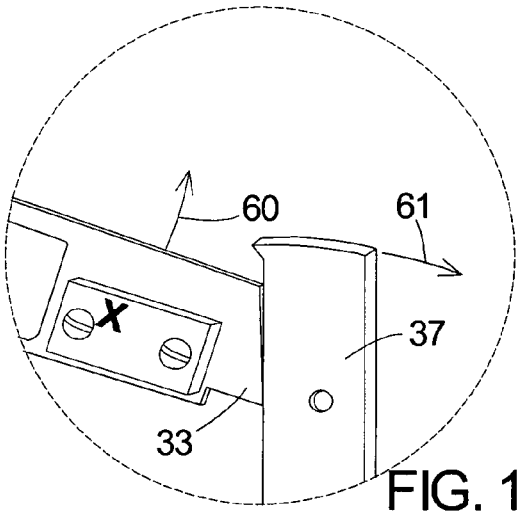
FIG. 11
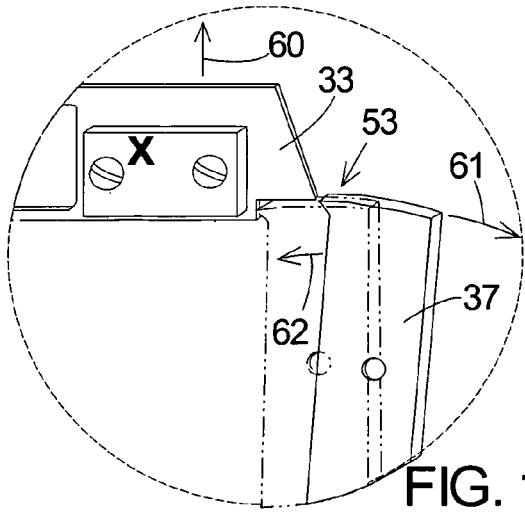
FIG. 12

START GATE FOR GRAVITY-DRIVEN CARS

CROSS REFERENCE TO RELATED APPLICATIONS

Not Applicable

FEDERALLY SPONSORED RESEARCH

Not Applicable

SEQUENCE LISTING OR PROGRAM

Not Applicable

BACKGROUND

1. Field of Invention

This invention relates to gravity-driven car racing, specifically a pendulum-based start gate for race tracks such as used in the popular Pinewood Derby race.

2. Prior Art

Literally millions of Pinewood Derby races have been run since the inception of the race in 1953, mostly by Cub Scouts and their parents. But the currently available race tracks, without exception, have a serious problem in their car start mechanisms. Refer to the prior art FIG. 1 which points out a typical spring-loaded start mechanism, a version of which is shared by all prior art tracks. FIG. 2 shows a typical location of the start gate at the top of an initial elevated track portion called a ramp. The spring force is supplied by strong rubber bands in some designs such as the original Cub Leader How-To Book design. In other designs the spring force is from a torsional hinge-type spring as in the Derby Magic design. But the spring force supplied to move the start posts is about 16 times stronger than necessary, and when the start gate is triggered the start post support structure must undergo a rapid deceleration or "slap" against the ramp bottom to stop its rotation. This "slap" deceleration occurs over a distance on the order of 30 times shorter than necessary. The above combined effects of a large spring force and short deceleration time cause the net deceleration force to be several hundred times more than actually needed. This "slap", even if damped with a cushion, still causes substantial vibration and impact motion of the ramp which jostles the cars, such as 20, thereby interfering with a smooth, fair start. The inherent performance capability of a car and the true winner will thus be masked by the above problem found in prior art start gates. More detail regarding gate "slap" will be provided in the Mechanical Theory section.

To further explain this problem, refer again to prior art FIG. 1, where we see that the items associated with the start gate are mounted on a plate 18 or on other ramp members such as a main support stand 17 or even the side of the ramp 19 itself. A plurality of start posts such as 22 are supported by some rigid member such as a wooden or metal bar 23 which is mounted to the ramp underside by a hinge with pivot 24. Upon release of the bar 23 the spring 26 causes the bar 23 to rapidly rotate around the hinge pivot 24 according to the motion arrows until the bar slaps with considerable force against the underside of the ramp. Whenever the bar 23 rotates, a lever 28 in the start switch assembly 27 causes a start signal to be sent to a race timer.

The references listed on the attached Information Disclosure Form are examples of prior art:

1) The Cub Scout Leader "How-To Book" is the oldest known start gate activation method. It teaches a start gate powered by a heavy rubber band.
2) The Micro Wizard web site teaches a spring-loaded start gate using two linear springs.
3) The Derby Magic web site teaches a spring-loaded start gate using a torsion-type spring.

SUMMARY

The basic inventive concept disclosed in this invention is an improvement in the design and operation of the common previously used spring-driven start gate for gravity-driven cars, such improvement being the elimination of the spring and a new design for the start gate. The invention eliminates the rapid deceleration of the spring-driven gate that ends its motion, known as "gate slap", which jostles the cars thereby making their start non-uniform and their race times more uncertain. The essence of the invention is first the realization that all such cars, being on an inclined ramp, are initially accelerated upon release at substantially less than 1 G, the acceleration due to gravity, whereas a pendulum bob or weight initially falls at precisely 1 G acceleration if it is released at a position horizontal with its fixed pivot point. The second realization is that the starting posts can also be given at least this 1 G acceleration if they are made part of a rigid body which can swing as a compound pendulum and whose effective center of mass is released from a point horizontal with the pendulum's fixed pivot axis. Details of these considerations are given in the Car Starter Mechanical Theory Section.

The over acceleration caused by springs is thus eliminated by allowing only gravity to act on a free-swinging compound pendulum gate assembly which results in a slow, uniform, and adequate initial start post motion of substantially 1 G acceleration. And because the pendulum is free swinging, the energy transmitted to the track, and thus to the cars, is spread out over several seconds, eliminating the gate slap of prior art start gates.

The subtle part of the invention is to guarantee no start post interference with the cars, either by a too slow initial swing away from the car front, or a too rapid back swing towards the receding car. Such interference can be avoided by proper design of the compound pendulum as realized in the preferred embodiment of the pendulum assembly.

DRAWINGS

Figures

FIG. 1 shows prior art associated with a car start gate.

FIG. 2 shows the standard location of the start gate, with car, at the top of a track ramp.

FIG. 3 shows a side view of the start gate mounted on a plate.

FIG. 4 shows a sectional view of FIG. 3 perpendicular to the track through the start posts.

FIG. 5 shows an enlargement of the journal bearing supporting the start post support rod.

FIG. 10A shows the pendulum assembly and trigger lever in a relaxed or uncocked state.

FIG. 10B shows motion of the drop member when first contacting the trigger lever.

FIG. 10C shows motion of the drop member just before and during cocking.

FIG. 11 shows enlarged detail of FIG. 10B

FIG. 12 shows enlarged detail of FIG. 10C

DRAWINGS - Reference numerals

Figure 6:
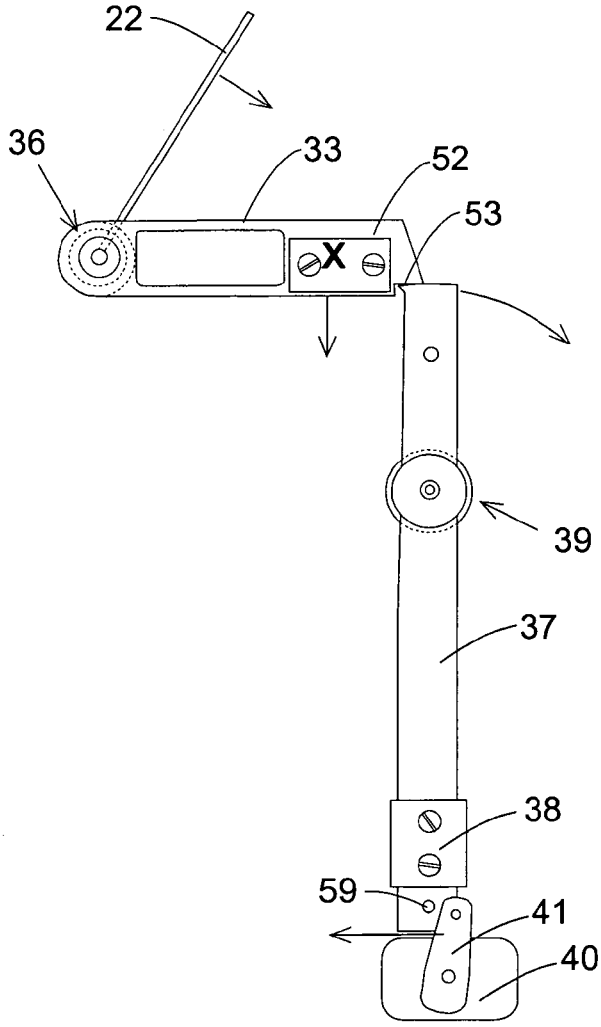
FIG. 6 shows side view detail of the pendulum assembly and trigger lever.

| | |
|---|---|
| 17 main ramp support | 18 first mount plate for start gate |
| 19 ramp side view | 20 gravity-driven car |
| 21 car nose | 22 start post |
| 23 start post support bar | 24 hinge |
| 25 start lever | 26 spring |
| 27 start switch assembly | 28 start switch lever |
| 29 electromechanical transducer assembly | 30 mounting bolts |
| 31 slots for start posts | 32 start post support rod |
| 33 drop member | 34 cut out opening in drop member |
| 35 effective center of mass (CM) | 36 first start rod journal bearing assembly |
| 37 trigger lever | 38 second weight |
| 39 trigger lever journal bearing assembly | 40 transducer or solenoid |
| 41 transducer or solenoid lever | 42 cord for backup trigger activation |
| 43 last of support post plurality | 44 set screw |
| 45 second mount plate | 46 weld joint |
| 47 journal bushing | 48 metal insert |
| 49 washer | 50 collar |
| 51 a second start rod journal bearing assembly | 52 first weight |
| 53 contact area on tip of trigger lever top | 54 brad pin |
| 55 bushing | 56 washer |
| 57 washer | 58 collar and set screw |
| 59 trigger lever pin | 60 drop member cock motion up |
| 61 trigger lever top cock motion to right | 62 trigger lever top cock motion to left |
| 63 finger | 64 slide rod |
| 65 hole for slide rod | 66 horizontal trigger member |
| 67 slot for horizontal member | 68 pivot for horizontal trigger member |

DETAILED DESCRIPTION OF A PREFERRED EMBODIMENT

FIGS. 2-10

Pendulum Start Gate Mechanical Description—FIGS. 2, 3, 4, 5, 6 and 7.

The location of a car and a start gate in this embodiment is the same as in prior art start gates as already shown at the ramp top in FIG. 2. The start gate comprises a combination of 1) a pendulum assembly and 2) a movable holding means for this assembly. The start gate in a holding or cocked state is shown in FIG. 3 along with a sectional view in FIG. 4. A main ramp support stand is 17 and a side view of the top of the ramp is 19. The start gate parts are mounted on a first flat plate or board 18 that is securely attached to the support stand 17, or ramp 19, by bolts such as 30. A gravity-driven car side view is 20, the car nose 21 resting against start post 22.

A rigid swingable assembly, called the pendulum assembly, is comprised of a drop member 33, a post support rod 32, and a plurality of start posts 22 through 43. A key part of the pendulum assembly is the drop member 33, whose left end is rigidly joined to a start post support rod 32, such rod passing, as a rotation axis, through the center of a first journal bearing assembly 36 which is shown in detail in FIG. 5. The entire pendulum assembly has an effective center of mass (CM), marked by a X as 35. The drop member 33 has a hole 34 cut out and also has a first weight attached to increase the rotation arm length to the CM. This weight is referenced later in an enlarged view. The pendulum assembly, after being released, swings freely. Post support rod 32 is supported at its ends by first and second journal bearing assemblies 36 and 51, such bearings also considered a part of the start gate. The start posts such as 22 completely clear the ramp upon swinging, as they initially protrude through the upper end of slots 31 of predetermined length.

In addition to the pendulum assembly and bearings, the start gate includes the movable holding means, specifically as trigger lever 37, shown in a vertical cocked state, with a second weight 38 on its lower end. The lever 37 can be rotated around a third journal bearing assembly 39. The trigger lever 37 may be remotely moved by an electromechanical transducer assembly 29. Thus a transducer 40 and its lever 41 can cause the required movement of trigger lever 37 by pushing against the trigger lever 37 bottom according to the motion arrow. A backup trigger activation is by slow hand pulling, in the arrow direction, on a cord 42 attached to the trigger lever 37 above the journal bearing assembly 39. As mentioned, there may be one or a plurality of lanes on the race track, each with a start post such as 43.

The journal bearing assembly 51 is the same as assembly 36 except there is no included drop member such as 33. The bearing assembly 51 is mounted in a second support plate 45 essentially identical to 18 except located on the opposite side of the ramp.

Of particular interest is the enlarged view of the journal bearing assembly 36 shown in FIG. 5. The start post support rod 32 protrudes through a journal bushing 47 with appropriate clearance for ease of rotation. The journal bushing 47 fits into a cylindrical metal insert 48 suitable for insertion into a hole placed in the bulk of the mounting plate 18. A lubricated washer 49 is just inside the end view of the drop member 33. Axial play is adjusted by positioning a collar 50 which is fixed to the start post support rod 32 by set a screw 44.

It is important that the drop member 33 be rigidly attached mechanically to the start post support rod 32. Thus 46 references a weld or solder joint joining the collar 50 to the drop member 33. The set screw 44 is tightened onto the start post support rod 32 when the start posts have been positioned perpendicular to the ramp with the drop member 33 in a near horizontal position. In operation, given in more detail later, a slight but purposeful movement of the trigger lever 37 according to one or the other of the motion arrows shown releases the drop member 33. Thus the entire rigid pendulum assembly is able to fall and swing under gravity forces as a compound pendulum. These forces can be viewed as acting only on the CM marked by the X shown as 35. As in the prior art description, this embodiment also allows a start switch assembly 27 to send a signal to the race timer whenever drop member 33 is released.

Figure 7:
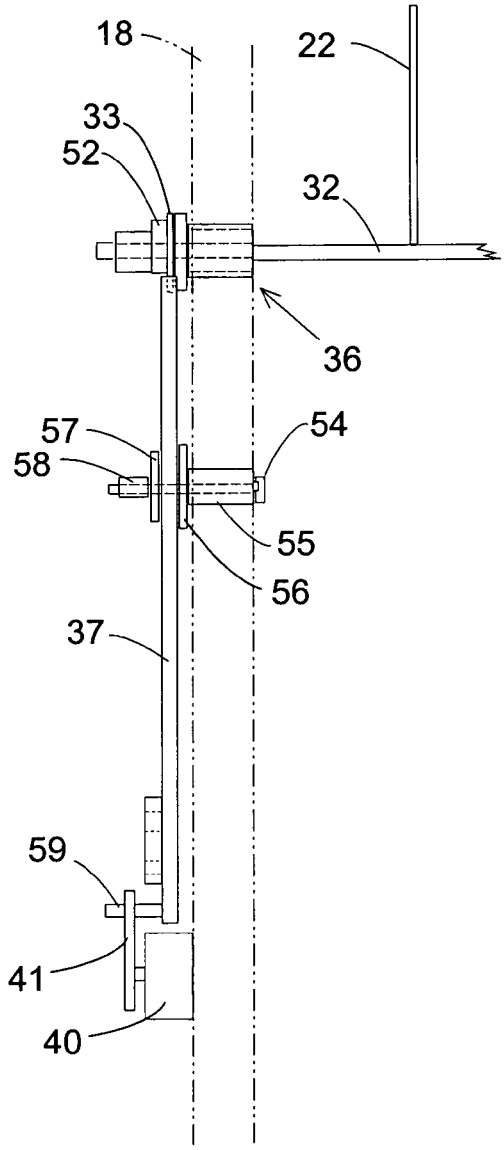
FIG. 7 shows front view detail of the pendulum assembly and trigger lever.

FIG. 6 shows a side view of the car start mechanism and FIG. 7 shows a front view. Here the pendulum assembly and mounting detail of the trigger lever 37 are shown. Items already referenced are given as background, including the start post 22 and start support rod 32, the drop member 33, the start support rod first journal bearing assembly referenced as 36, the trigger lever journal bearing assembly 39, the trigger lever 37 and second weight 38, and the transducer parts 40 and 41. FIG. 6 shows the first weight 52 on the drop member which is similar to the second weight 38 on the trigger lever 37. Also pointed out is the overlap or contact area 53 between the trigger lever 37 and the drop member 33. Item 59 is a pin into the bottom of the trigger lever 37 for contact with the transducer lever 41.

The front view in FIG. 7 shows that the trigger lever journal bearing assembly 39 is composed of a bushing insert 55, a brad pin 54, a set-screw adjustable collar 58, and inside and outside washers 56 and 57. Except for the drop member weight 52, details of the first start rod journal bearing assembly, item 36, are best seen from the sectional view in FIG. 5. The journal bearing assemblies 36 and 39 are both fixed in the mounting plate 18. Regarding the weights 38 and 52, in this embodiment they are shown as rectangular pieces available from commercial sources as a high density tungsten metal of about ½ ounce weight. When the transducer 40 is activated its lever 41 pushes to the left against pin 59 causing the top of the trigger lever to move right according to the motion arrow. Note the trigger lever top contact area 53 is curved with proper radius in a circular arc to prevent the trigger lever motion from moving the drop member prior to its drop. As soon as the top of the tip of the trigger lever 37 clears the rightmost part of the drop member 33, the drop member falls according to the downward arrow.

We therefore have a pendulum whose complete motion, although studied thoroughly since the $17^{th}$ century, nevertheless is not well-known in detail to the general public. The following theory will help in teaching the application of this embodiment to prior art practitioners.

Figure 8:
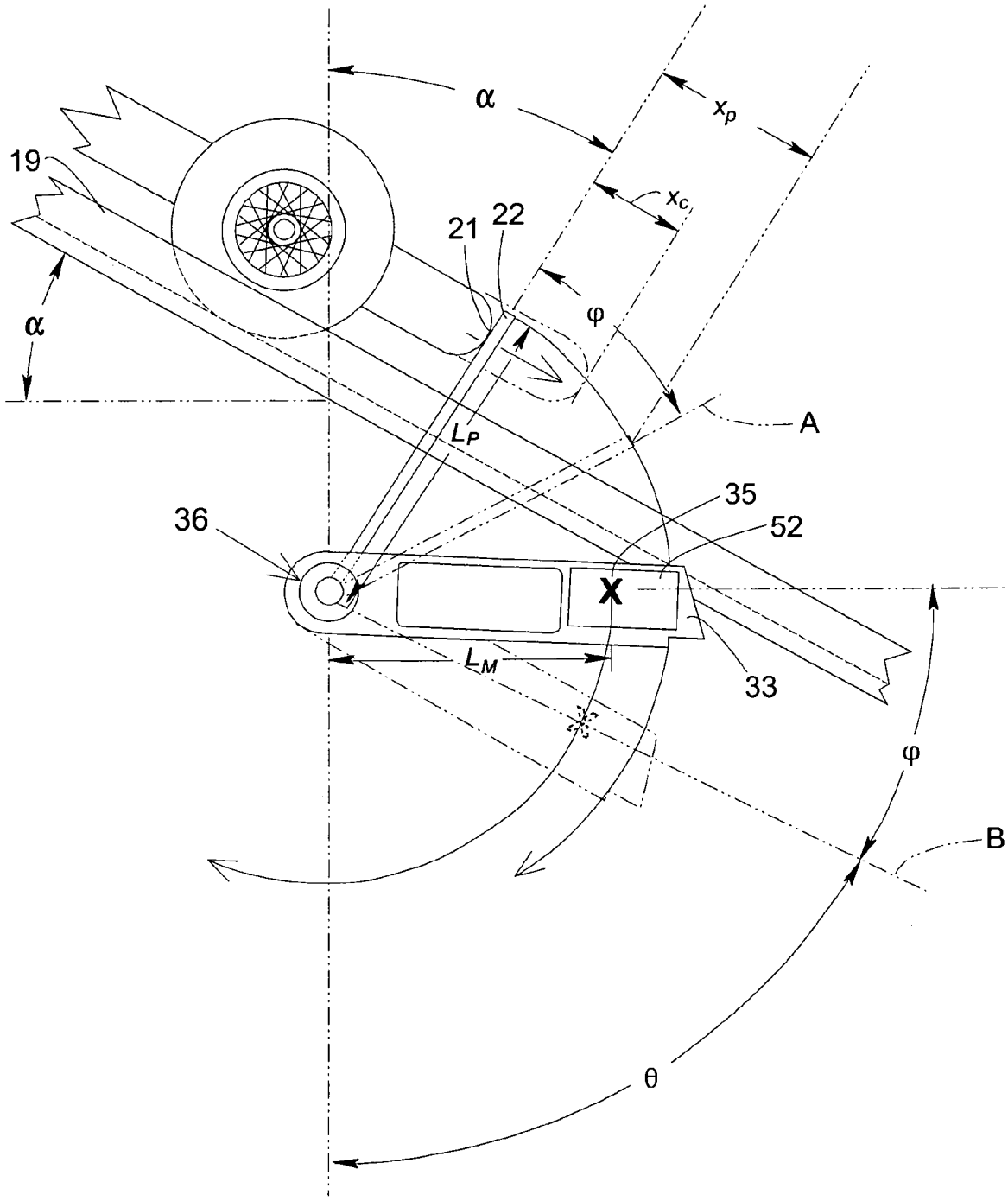
FIG. 8 shows detail of pendulum assembly and car motion during and after start.
Figure 9A:
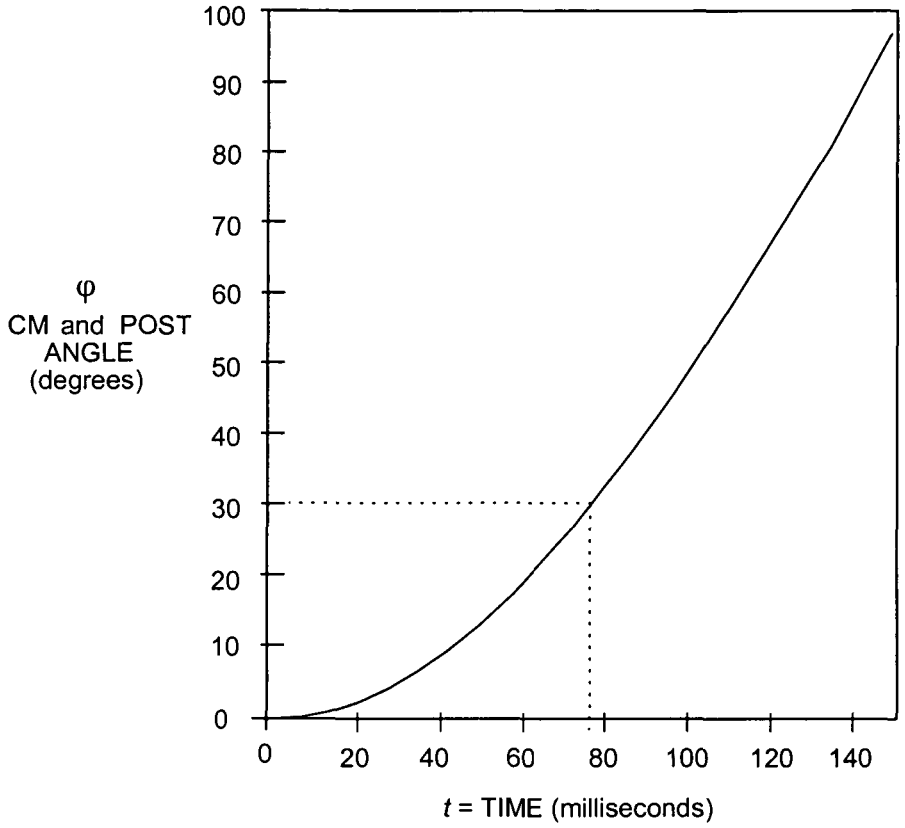
FIG. 9A shows a graph of the CM and the start post tip angles after starting.
Figure 9B:
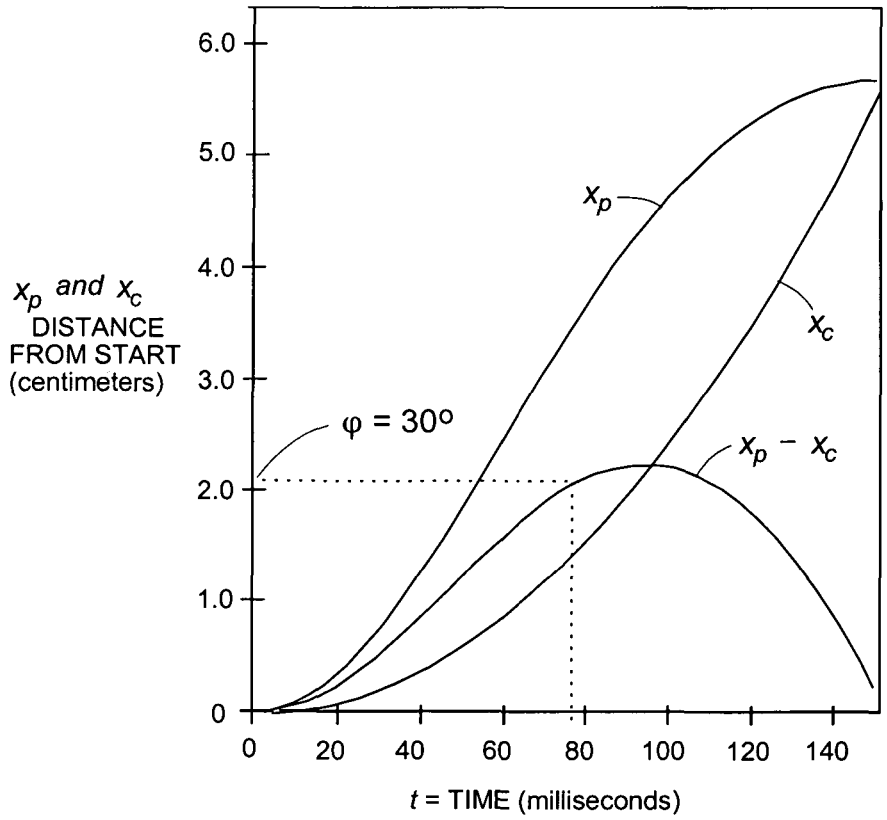
FIG. 9B shows a graph of the car front and the start post tip positions after starting.

Car Starter Mechanical Theory—FIGS. 8, 9A, and 9B

The uniqueness and non-obvious functioning of the start gate is revealed by an examination of the physical theory as depicted by FIGS. 8, 9A, and 9B. In FIG. 8 we show:

Motion arrows showing movement of 3 objects:

a) a straight down-track motion of the tip of the car nose 21 b) a circular motion of the tip of the start post 22 c) a circular motion of the CM 35 of the pendulum assembly.

Linear distance symbols are shown between smaller arrows as:

a) a distance $x_C$ as the down-track movement of the car nose 21 b) a distance $x_P$ moved down-track by the projection on the track of the start post tip 22 c) a rotation arm length $L_M$ measured from the pivot center of the bearing assembly 36 to the CM of the swinging pendulum assembly as marked by an X d) a radius $L_P$ of the arc defined by the motion of the start post tip 22.

Angular distance symbols are shown between smaller curved arrows as:

a) an angle $\alpha$, the constant ramp angle with the horizontal, usually within 20 to 30 degrees b) an angle $\phi$, a measure of the start post tip 22 and the pendulum assembly CM 35 rotation c) an angle $\theta$, which measures the rotation relative to the vertical; the angle $\theta$ in the cocked state being 90° (equal to $\pi/2=1.5708$ . . . in radian measure), and the angle $\theta$ in the at-rest state when the CM is aligned with the vertical is $\theta=0°$.

The weight 52 ensures that the CM will be approximately in the position shown at the right end of the drop member 33. This CM is an effective CM for the noted pendulum rotation and not an overall 3-dimensional CM of the pendulum assembly. Because the pendulum assembly is a rigid body, the start post tip 22 and the start assembly CM will both move according to the same angle $\phi$.

The projection of the start post tip onto the down-track direction is measured by $x_P$. After start, initially this distance $x_P$ must remain larger than the car nose 21 distance $x_C$ in order to avoid start post interference with the car. It should be noted that $\alpha$, which is the angular displacement of the initial start post position from the vertical, is also the angle which the ramp 19 top part makes with the horizontal. In all practical ramps a never exceeds 30° so we will use this value of $\alpha$ below.

When the drop member 33 is allowed to drop, initially the CM will drop vertically with an acceleration of 1 G (1 G=earth's gravitational acceleration) and the start post tip 22 will also begin to move down track under an acceleration of 1 G. But the car body nose 21 will initially begin to move down track under an acceleration of only 0.5 G, half as much. This is because the component of gravitational force in the direction of motion of the car down the incline of the ramp is reduced by $\sin\alpha=0.5$. The formula for distance x moved from rest under a constant applied force can be derived from Newton's second law as $$x = \frac{1}{2}at^2 \tag{1}$$

where $\alpha$ is a constant acceleration and t is the time. If we solve Eq (1) for the time t and then substitute 1 G and 0.5 G for $\alpha$, we have for the start post and car nose right after start that $$x_P = \frac{1}{2}Gt^2 \text{ start post distance} \tag{2}$$

$$x_C = \frac{1}{4}Gt^2 \text{ car nose distance.} \tag{3}$$

Thus, we have that $$x_C = \frac{1}{2}x_P$$

and when the post tip has moved, say, 5 thousandths of a centimeter (2 thousandths of an inch) from rest the car nose has moved only 2.5 thousandths of a centimeter (1 thousandth of an inch). But even as the car acceleration remains constant over the first meter or so, the start post acceleration and $x_P$ increase rate become progressively less as the CM falls and the angle $\phi$ increases. We must therefore consider the full pendulum motion, starting first for a small angular swing and then for a full swing of interest from $\theta_o=90°$.

The motion of a pendulum as taught by most physics texts relies on an approximation of swinging about a small angle. For a small release angle $\theta_o$ the time t and angle $\theta$ from start are:

$$t = \sqrt{\frac{L_M}{G}}\cos^{-1}\left(\frac{\theta}{\theta_o}\right) \tag{4}$$

-continued $$\theta = \theta_0 \cos\left(\sqrt{\frac{G}{L_M}}\, t\right). \tag{5}$$

In FIG. 8 we use the traditional angle θ to describe the pendulum motion where θ=0 is the vertical rest position of the pendulum CM. One may convert back to ϕ at any time using ϕ=π/2−θ (radian measure). In the FIG. 8 case, θ is not small, as motion starts at $\theta_O=\pi/2=90°$. We must therefore consider full motion of such a pendulum which is described by a rather complicated function called an elliptic integral of the first kind. The appropriate formula to use for the exact time for a pendulum swing from any start angle $\theta_o$ to pass the vertical at θ=0 comes from the series representation of the elliptic integral of the first kind. This series is now used as a replacement of the inverse cosine function in Eq (4) giving:

$$t = \frac{\pi}{2}\sqrt{\frac{L_M}{G}}\left[1 + \left(\frac{1}{2}\right)^2 k^2 + \left(\frac{3}{2\cdot 4}\right)^2 k^4 + \left(\frac{3\cdot 5}{2\cdot 4\cdot 6}\right)^2 k^6 + \ldots\right] \tag{6}$$

$$\text{where } k = \sin\left(\frac{\theta_o}{2}\right).$$

The correction to Eq (4) is on the order of 34% slower for $\theta_o=90°$ and in Eq (5) the corrected angle θ is correspondingly smaller (and thus ϕ larger) for a given time t.

If we use various ϕ as the complement for various $\theta_o$ in Eq (6) and plot the results we get FIG. 9A which shows how ϕ depends on the time t. For example, FIG. 9A shows that when ϕ=30°, the time is 77 milliseconds (ms) after start.

The down-track projection distance of the start post tip is $$x_P = L_P \sin\varphi = L_P \sin\left(\frac{\pi}{2} - \theta\right). \tag{7}$$

Then, choosing typical distances $L_P$=5.72 cm (2.25 in) and $L_M$=5.08 cm (2.00 in), in FIG. 9B we plot the start post tip distance $x_P$ down-track from Eq (7) for increasing t. Also plotted is the simple quadratic function in Eq (3) giving the car nose position $x_C$. The separation distance between the start post tip and the car nose is $x_P-x_C$. In FIG. 8 we show the start post tip at the position A when the CM has rotated to position B, both at ϕ=30°. At this rotation angle, occurring at 77 ms from start as seen in FIG. 9A, the tip becomes lower than the car body bottom and from then on it is clear there is no possibility of post interference with the car. FIG. 9B shows that when this occurs at 77 milliseconds (ms) from start the post tip is already about 2 cm ahead of the car nose. The separation continues to increase to a maximum at about 95 ms at which point the angle ϕ is almost 45° and the start post tip is passing beneath the ramp top surface. For larger angles ϕ the distance $x_P$ is the post projection onto the bottom of the track.

The pendulum assembly continues to swing down and to the left as the car passes overhead. If a slow car has so much friction that the start post on its back swing (at about t=500 ms) could interfere with the car bottom, then the car would not have reached the finish line even without such interference. Thus it is proven that a pendulum start post cannot interfere with a car, even with a rather steep ramp angle of 30°. Some ramps may have an incline angle α as low as 20°. The initial acceleration of a car is then only 0.34 G. There would thus be even more distance between the car nose and the falling start post compared to the 0.50 G case just considered where α=30°. When installing the pendulum assembly on a new specific ramp, the set screw 44 is tightened with the drop member 33 horizontal with the start posts 22 positioned perpendicular to the ramp surface. This gives a proper angle between the start posts and drop member. The pendulum assembly, especially the journal bearings, can be factory installed on mounting plates 18 and 45 for quick retrofit installation on any of the popular ramps in the field.

As a final point of theory, we can compare the gate slap deceleration force of a prior art spring-loaded pendulum assembly with the present embodiment. Prior art springs use a cocking force of about 454 g (one pound, or 16 oz). On the average, ½ of this force, or 227 g (8 oz), travels about 5.08 cm (2 inches) as the spring is stretched. This leads to an energy of force times distance equal to 1153 g-cm (16 oz-in). This energy content must be dissipated by mashing, say, a 0.635 cm (¼ inch) diameter rubber tubing used as a cushion between the rotating start gate hinge 24 or post support bar 23 and the ramp bottom. The deceleration force is then the energy content divided by the impact distance giving 1816 g (64 oz). On the other hand, the pendulum starting energy content is simply the 14.2 g weight (½ oz) raised to a height of 5.08 cm (2 inches) or 72.1 g-cm (1 oz-in). The pendulum will swing back and forth about 3 or 4 times with the CM traveling a total distance on the order of 15.2 cm (6 inches) before coming to rest. The net average deceleration force, which is dissipated as friction in the journal bearings 36 and 51, is only 4.73 g (0.17 oz). The prior art deceleration force is thus about 384 times more than in the current embodiment. Notice all masses above are actually their weight, i.e., force, equivalents.

OPERATION OF PREFERRED EMBODIMENT

FIGS. 6, 10A, 10B, 10C, 11, and 12

In FIG. 6, the pendulum assembly, shown in a cocked position, is allowed to fall when the bottom of the trigger lever 37 is moved to the left by the transducer lever 41, such lever being activated remotely through either a radio signal to the transducer 40 or a direct signal sent by wires from a remote activation means. The trigger lever 37 top then rotates in the indicated direction, allowing the drop member 33 and the connected start posts 22 to fall in the indicated directions, thereby releasing the cars to gravitational acceleration. Subsequently, the pendulum assembly swings back and forth a few times and stabilizes in a few seconds in a vertical position. Thus, referring to FIG. 10A, this vertical rest position is with the CM 35 directly under the center of the journal bearing assembly 36. This position was referred to as the θ=0 position in FIG. 8.

FIG. 10B shows how, after each race, the pendulum assembly is re-positioned allowing the trigger lever to re-cock itself. Thus, the drop member 33 is simply manually lifted towards the horizontal position in direction 60 as shown. As the drop member 33 is raised in direction 60, its angled right tip rubs against the left side of the trigger lever 37. Continued raising of drop member 33 is shown in FIG. 11 as forcing the top of the trigger lever slightly to the right in direction 61. The trigger lever 37 thickness is a predetermined amount larger than the contacted drop member 33 thickness to insure continuous rubbing contact during cocking even in the presence of some play in bearing assemblies 36 and 39. In FIG. 10C we see the drop member tip just on the verge of passing the top of the trigger lever, as noted in the contact region 53 in the magnified view of FIG. 12. Continued lifting of the drop member 33 in direction 60 allows the trigger lever 37 top, attempting to maintain its natural vertical position, to slip to the left in direction 62 into the notch on the bottom of the drop member, completing the cocking operation.

The pendulum assembly is now cocked and in a holding position as shown by the phantom lines in FIGS. 10C and 12. The start posts are also in a position perpendicular to the ramp surface, and further raising of the drop member is stopped. At this point, the race timer may also reset for the next race event. In preparation for the race event, the cars may now be placed in their appropriate lanes, being restrained by the start posts. After each race, the start gate cocking process and race timer reset may be repeated and the cars again returned to the top of the ramp and placed in their start positions.

DETAILED DESCRIPTION OF ALTERNATE EMBODIMENTS

FIGS. 13-15

Earlier, in the preferred embodiment, the start gate used natural action from a rigid pendulum assembly, such an assembly including a drop member and parallel start posts arranged at a specific angle with respect to the drop member. The car start method thus described captures the main essence of all embodiments. Secondary to this main essence are the various embodiments specific to means that could be used to hold and then "trigger", i.e., release, the drop member 33, whereby the start gate pendulum assembly motion can begin.

Figures 13, 14, 15:
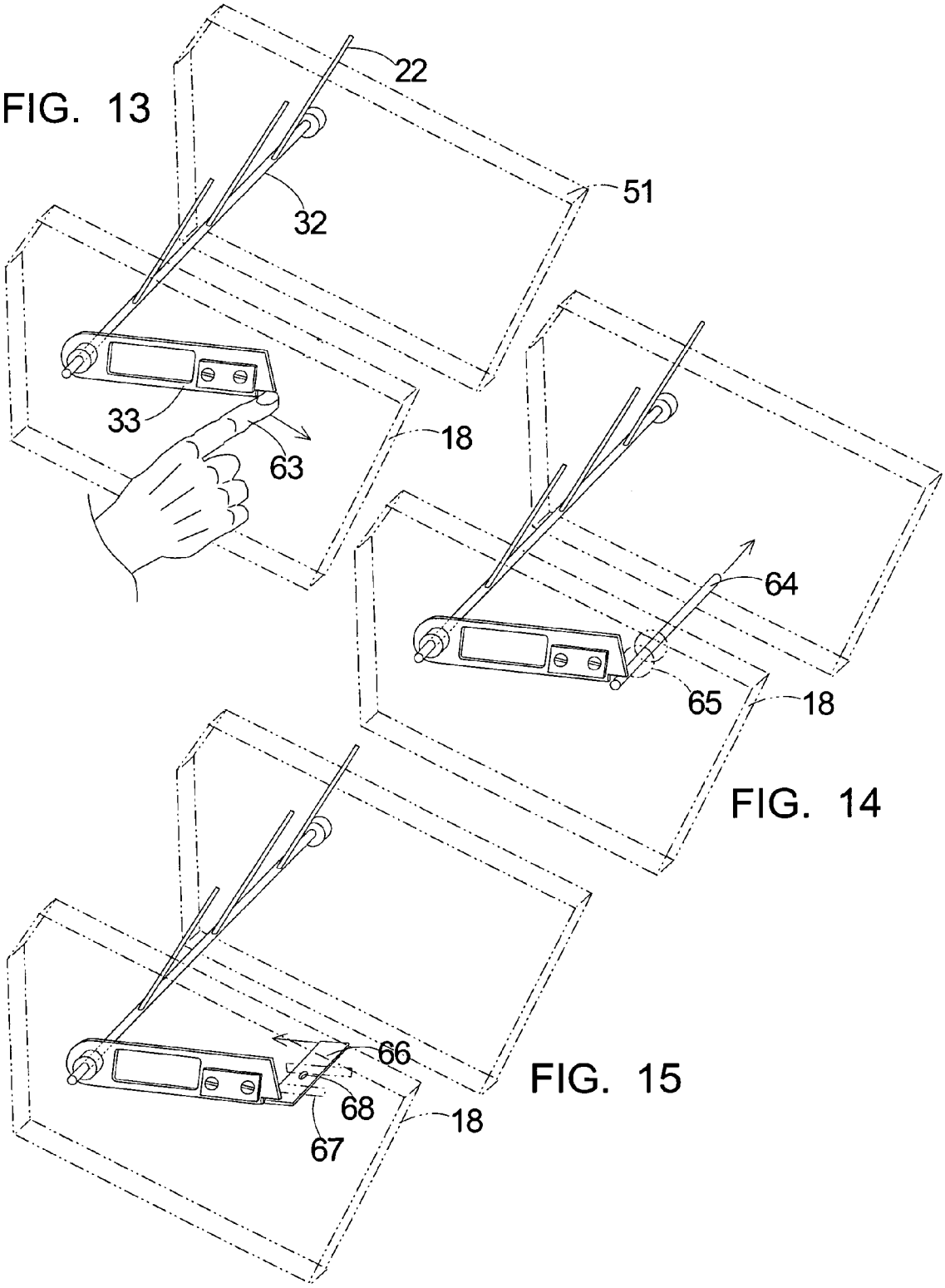
FIG. 13 shows a finger used as a trigger release
FIG. 14 shows a rod used as a trigger release
FIG. 15 shows a horizontal lever used as a trigger release

In FIG. 13, the simplest hold and trigger arrangement is shown. As in the earlier preferred embodiment descriptions, FIG. 13 shows the pendulum assembly composed of start posts 22, start post support rod 32, and drop member 33. The pendulum assembly is supported by journal bearings in mounting plates 18 and 51 also as described earlier. The simplest embodiment is then to merely use a finger 63 to hold the drop member horizontal until the cars are placed. Then just move the finger in the arrow direction to release the drop member 33 and start the race.

In FIG. 14 the drop member is held stationary by a rod 64 that protrudes through an opening 65 of predetermined size in the mounting plate 18. Moving the rod in the arrow direction releases the drop member to start the race. Equivalently, the rod 64 could be hand-held, positioned similar to the finger 63, then moved.

In FIG. 15 the drop member is held stationary by a horizontally mounted trigger lever such as 66. Here the lever is mounted in a slot 67 in the mounting plate 18. When the inside end of the lever is moved according to the arrow direction, the lever pivots around a centrally located point 68. This action then releases the drop member and start posts allowing the race to start.

An earlier mechanical theory analysis of the car vs. pendulum motion supposed an initial precisely horizontal position for the drop member. However, the drop member angle could in fact be several degrees higher or lower than horizontal without compromising a smooth start.

CONCLUSIONS, RAMIFICATIONS, AND SCOPE

Accordingly, the reader will see that, according to all embodiments of the invention, there is provided a theory and description of the operation of a compound pendulum-driven start gate suited for small gravity-driven cars. But the same principles could be applied to the start gates of larger cars with drivers, such as soap box derby cars, or full-size engineless cars used to study behavior such as aerodynamics using only gravity-driven acceleration and associated timing.

Until this invention, the fact that a springless start could be arranged whereby there would be no gate "slap" causing undesirable ramp and car motion had been overlooked. But as derived in the preferred embodiment description, a close examination of the motion shows the conclusion that a gravity-driven start gate with a swingable pendulum assembly makes an ideal smooth-start mechanism that is guaranteed by Newton's second law not to interfere with the natural car motion. An important ramification of this invention is that the precision of a timed gravity-driven race can be substantially improved compared with the prior art. This makes possible an improvement in the fairness of the many races run annually.

While the above invention contains many specificities, these should not be construed as limitations on the scope of any other possible embodiments, but rather as examples of the presently presented embodiments. Thus the scope of the invention should be determined by the appended claims and their legal equivalents, and not by the descriptive examples given. For example, the trigger lever does not have to be a self-cocking vertical design as indicated in the preferred embodiment. As shown, any means for keeping the drop member in a horizontal position such that it can be dropped on command will suffice to reap the benefits of the smooth pendulum start. Even a finger, or a stiff piece of material that extended under the drop member notch, could be moved in a horizontal plane to allow the member to fall. Also, a drop member only approximately horizontal and a ramp angle larger than 30° can still provide a smooth start.

I claim:

1. A start gate, for one or a plurality of gravity-driven cars, comprising (a) a pendulum assembly which acts as a free-swinging compound pendulum, said pendulum assembly using only a natural gravity-derived motion to move one or simultaneously move a plurality of parallel start posts at an acceleration of at least 1 G, where 1 G is the acceleration due to gravity, thus allowing natural gravitational forces to begin moving said cars down an inclined ramp at some natural acceleration less than 1 G;

(b) said pendulum assembly including a horizontally mounted elongated member with pivoted ends upon which said start posts are perpendicularly extended while fixed at one end to said elongated member;

(c) said pendulum assembly also including a drop member with a pivot end rigidly attached perpendicularly to said horizontally mounted elongated member, and wherein said drop member contains a specific effective center of mass of said pendulum assembly, said effective center of mass having a predetermined perpendicular distance from a rotation axis determined by said pivoted ends of said elongated member, said distance called a rotation arm length of said pendulum assembly;

(d) said pendulum assembly also including a structural means for adjusting said drop member to be at a constant angle relative to said start posts such that said start posts are perpendicular to said inclined ramp in use when a line from said rotation axis to said effective center of mass is in an approximately horizontal position, and (e) said pendulum assembly capable of being released by purposeful action after said line from said rotation axis to said effective center of mass has been put in said approximately horizontal position, whereby said action allows said pendulum assembly to rotate as said compound pendulum around said pivoted ends while said rotation simultaneously causes said start posts to gently swing away from and release said cars without interference, thereby avoiding undesirable motion to said ramp and said cars from a sudden start or stop action of overly-forceful start post movers such as in spring-loaded start gates.

2. The pendulum assembly of claim 1 wherein said pivoted ends rotate in bearings appropriately fixed under opposite undersides of said inclined ramp.

3. The pendulum assembly of claim 1 wherein said drop member is cut out and weighted in order to increase said rotation arm length to said effective center of mass of said pendulum assembly.

4. The pendulum assembly of claim 1 wherein said structural means for adjusting said drop member angle comprises a collar containing a set screw, said collar being fixed to said drop member pivot end, said set screw and said collar combination able to slip over one end of said elongated member, and said set screw thus able to be used for fixing said drop member to said elongated member at a constant predetermined angle relative to said start posts.

* * * * *